United States Patent [19]

Lange

[11] 3,934,407

[45] Jan. 27, 1976

[54] METHOD OF AND APPARATUS FOR PRODUCING PARTICULARLY HIGH-STRENGTH CHAINS

[75] Inventor: Gerhard Lange, Baden-Wurttemberg, Germany

[73] Assignee: Wafios, Maschinenfabrik, Wagner, Ficker & Schmid, Reutlingen, Germany

[22] Filed: Sept. 20, 1974

[21] Appl. No.: 507,802

[30] Foreign Application Priority Data

Sept. 22, 1973 Germany ..... 2347768

[52] U.S. Cl. ..... 59/31; 59/18; 59/22; 59/25; 59/35

[51] Int. Cl.[2] ..... B21L 3/02

[58] Field of Search ..... 59/34, 31, 33, 35, 26, 59/25, 22, 18

[56] References Cited

UNITED STATES PATENTS

| | | | |
|---|---|---|---|
| 798,692 | 9/1905 | Muller | 59/34 |
| 2,684,422 | 7/1954 | Esser et al | 59/31 |
| 2,688,838 | 9/1954 | Wattler | 59/34 |
| 3,389,552 | 6/1968 | Weischede | 59/34 |
| 3,552,118 | 1/1971 | Reiter et al | 59/31 |
| 3,701,253 | 10/1972 | Wust | 59/31 |

FOREIGN PATENTS OR APPLICATIONS

| | | |
|---|---|---|
| 904,259 | 2/1954 | Germany |
| 1,023,536 | 1/1958 | Germany |

*Primary Examiner*—C. W. Lanham
*Assistant Examiner*—James R. Duzan
*Attorney, Agent, or Firm*—Wigman & Cohen

[57] ABSTRACT

Method of and apparatus for electrically butt-welding high-strength chains. Previously bent and interengaged chain links are passed through a chain welding machine, each chain link in succession being alternately rotated about its axis and erected to a vertical position for engagement by upsetting members and welding electrodes.

21 Claims, 10 Drawing Figures

Fig.9.
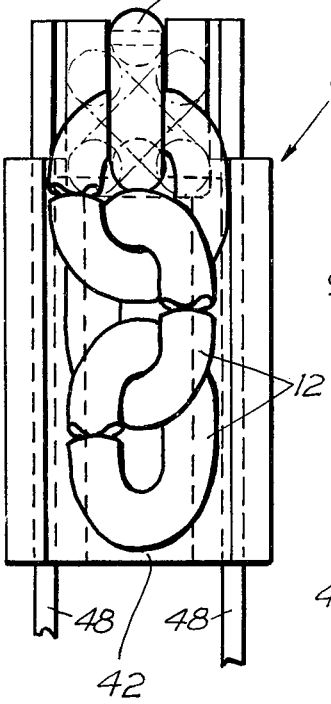
Fig.7.
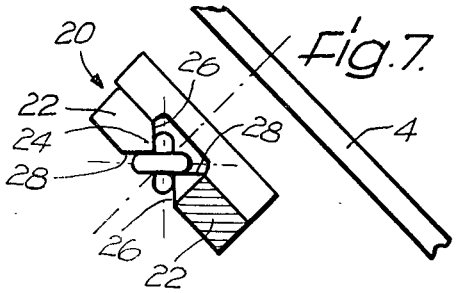
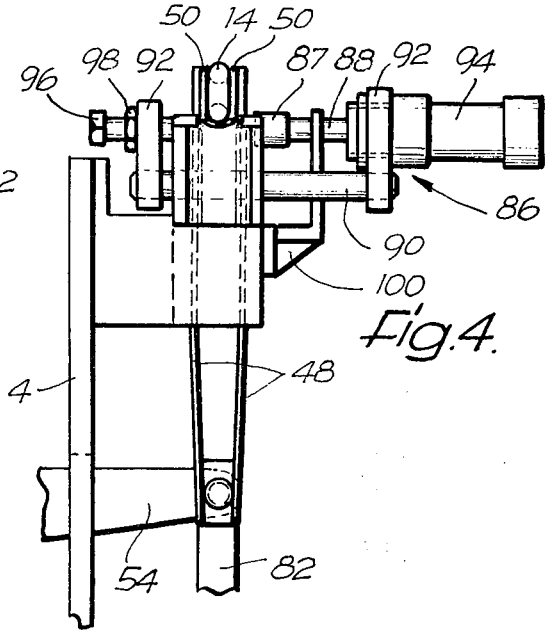
Fig.4.
Fig.10.
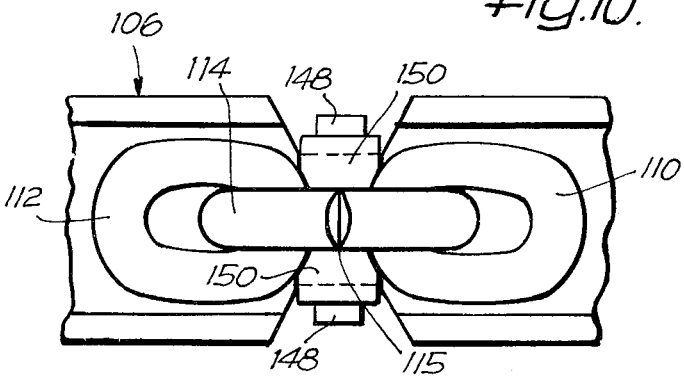

METHOD OF AND APPARATUS FOR PRODUCING PARTICULARLY HIGH-STRENGTH CHAINS

BACKGROUND OF THE INVENTION

This invention relates to chain welding machines and processes and more particularly to a method of and apparatus for rotating and erecting successive chain links prior to butt-welding.

Prior apparatus and methods of producing high-strength chains fall in two principal categories. In the first, a strand of C-shaped pre-bent and interengaged chain links is, after bending, intermediately stored prior to being laid in a chain-welding machine which, in a first pass of the chain strand, welds only every second chain link. After another intermediate storage, the partly completed chain is again laid into the same chain-welding machine for final welding of the remaining chain links. The initial intermediate storage after bending and prior to welding is necessary because the output of a chain-bending machine which bends successive chain links is greater than the output of a chain-welding machine which, in one pass, welds only alternating chain links. Such manufacturing processes have disadvantages attributable to the two-fold intermediate storage and the second pass. Intermediate storage requires space, transporting of work, and involves the risk that the ends of the chain links which are not yet welded may become contaminated so that welding defects may result. Since during the second pass, two previously welded chain links are suspended in each unwelded chain link and differ therefrom by having a shorter length, a lower electrical resistance and a greater heat conductivity, the chain-welding machine must, for the second pass, be reset in terms of electrical output as well as stroke and position of its transporting tools. Despite so-called chain monitors, it is not altogether impossible for chain links to become tangled and squashed during either intermediate storage, requiring manual labor to arrange the chain strand before passage through the chain-welding machine so as to insure trouble-free running.

In the second category of manufacturing process and machine, the chain strand emanating from the chain-bending machine passes without being intermediately stored through a first chain-welding machine which in turn welds only alternate chain links. The half-welded chain strand thence passes through a second chain-welding machine which welds the remaining chain links. This uninterrupted manufacturing process, however, requires a second chain-welding machine and dictates a relatively slow operating rate of the chain-bending machine which is capable of a far greater output. Furthermore, a disadvantage common to both the aforementioned categories of manufacturing processes is that, in the chain-welding machine transport mechanism the chain strand has to be sharply accelerated and decelerated by two divisions, i.e., the length of two chain links, if the non-productive or dead time between welds is not to assume tremendous proportions. Such acceleration and deceleration, however, entail the risk that the chain link to be welded will be inaccurately positioned, resulting in a potentially faulty weld. Since a traction test can be performed only on a completely welded portion of the chain strand, traction tests cannot be carried out on chains made in either of the prior manufacturing processes until all the chain links have been welded. Should a test subsequently disclose welding faults, a relatively considerable loss of material and time results.

A manufacturing process of the type described in German Pat. Specification No. 1,023,536 substantially avoids the aforesaid disadvantages in that one chain link after another is welded, so that a synchronous operation of only one chain link welding machine with a chain-bending machine is possible. However, when carrying out this known manufacturing process, the output of conventional chain-bending machines cannot be fully exploited because the manual rotation through 90° of the next chain link to be welded results in wastage of a relatively considerable amount of time. In addition, when welding small chain links, the rotation has to be performed very frequently which has a substantially adverse effect on the output.

STATEMENT OF THE INVENTION

Therefore, in view of the foregoing, it should be apparent that there is still a need in the art for a more rapid and efficient method of and apparatus for producing particularly high-strength chains.

It is, therefore, a primary object of the present invention to improve the production rate of chain welding apparatus by providing a method of and apparatus for automatically welding successive links of a chain strand.

Another object of the invention is to provide a simply constructed yet effective apparatus for welding successive links of a chain strand.

Still another object is the provision of chain-welding apparatus the output of which more closely approximates the output of a chain wire bending machine.

Yet another object of the invention is to eliminate the necessity for intermediate storage of a chain strand between separate passes through a chain-welding machine.

More specifically, it is an object of the present invention to provide a chain-welding apparatus for automatically rotating and erecting successive links of an unwelded chain strand for engagement by welding electrodes.

Other objects, advantages and features relate to the structural details and novel combinations and arrangements of the invention which will appear from a reading of the following detailed description when considered in conjunction with the accompanying drawings.

According to the present invention, these and other objects that may become hereinafter apparent are accomplished by providing a chain strand, transported over a zenith, guided at least on the approach side so that in each case the plane common to all chain links of a first and second row or series of interconnected chain links staggered by one chain link forms, with the plane of an upright chain link disposed at the zenith, a definite positive or negative angle, respectively, which is at most approximately 45°. The chain link at the zenith, after transporting of the chain strand and prior to welding, is moved into an upright position in the middle plane between both of said planes and is securely held in this position. The movement of the chain link which is to be welded, accompanied by simultaneous rotation about its longitudinal axis by at most 45° may be performed more readily and at least twice as rapidly as a rotation through 90°. The angle of 45° results because the planes of two consecutive chain links, i.e., one link of each of said first and second rows, enclose an angle of 90° and the two rows of chain links are equally inclined with respect to the vertical central plane. By reason of the fact that the chain strand is drawn over a zenith and despite the lack of guidance at the zenith, a natural angle of approximately 45° is created between the chain link at the zenith and the central plane. Chain links which are guided at least on the approach side by virtue of their weight, exert a force on the chain link at the zenith and so approximately secures its oblique position until such time as it is erected. If the guidance on the approach side is so undertaken that the angle between the central plane and the plane of those chain links to which the chain link to be welded and which is at the zenith belongs, is less than 45° and if the traction forces exerted on the chain link which is to be welded are sufficient, then the chain link at the zenith will enclose with the central plane a correspondingly smaller angle so that alignment may be accomplished in a still shorter time.

In carrying out the method for rotation and erection of the chain link about its longitudinal axis according to the invention, the parallel portions of the chain link are substantially simultaneously subjected to a coupling of forces to produce a straightening-up or erection torque. With this manner of implementing the invention, the movement of the chain link which is to be erected is consequently restricted to a purely rotary movement. The fact that the axis of rotation which coincides with the longitudinal axis of the chain link is substantially stationary during rotation, is attributable to the traction forces exerted on the chain link to be welded. The traction forces created by the weight of the other chain links do not have a common direction of action but do have a common plane of action.

One advantage of the foregoing production method of the present invention is in that the output of a chain-bending machine may be equalled by that of a chain-welding machine so that a chain link is bent and simultaneously a previously bent chain link is welded.

An apparatus for practicing the method according to the invention includes a saddle for supporting the chain link to be welded with guides for the approach or discharge of the chain strand and with oppositely movable compressing tools for engaging the rounded portions of the chain link to be welded. An example of this type of apparatus is described in German Pat. No. 904,259. The saddle which supports the chain link to be welded functions to lift the chain link out of the mass of the other chain links and provides free access to the compressing tools. This function is particularly important in the case of short-link chains.

In the apparatus to the present invention, a guide is provided on at least the approach side of the saddle. The guide forms at least one first and one second guide surface for a first and second row of chain links respectively, said rows staggered by one chain link and enclosing an angle measured above and below the chain strand of, at most, approximately 45°. Further, means are provided for moving the chain link which is to be welded out of its natural inclined position on the saddle into an upright or erect position in the central plane and for laterally holding the chain link securely in this position. From German Pat. No. 1,023,536, an apparatus is already known which has a device for gripping fast the chain link which is to be welded. However, this gripping device holds the chain link to be welded at its opposite rounded positions along its longitudinal axis for exertion of a compression force. This so-called clamping device consists essentially of two arms which are jointly pivotable about a horizontal axis, of which one is movable, forming a type of gripper together with the fixed arm. Each arm is provided with an open recess to receive a rounded part of the chain link to be welded and, at right angles to the open recess, another recess for receiving the subsequent or preceding chain link.

In the apparatus according to the invention, each guide is provided with a first and second pair of parallel guide faces or flanks which orient and guide the two straight portions of all chain links in the two mutually perpendicular rows of links, i.e., a first pair of guides for the first row and a second pair for the second row. The guide faces are constructed in the form of confronting wedges, the parallel faces of the opposing wedges engaging a chain link of one of the two chain link rows. The flanks of each wedge expediently form a right angle. Thus, in a simple but reliable manner, the necessary guidance of the chain link at the correct angle is insured. It is preferred that the saddle have an upwardly open trough, the cross-section of which is substantially in the shape of a segment of a circle. In consequence, the saddle imposes no resistance to the torque which tends to erect the chain link to be welded, but instead the rounded portion of the trough facilitates rotation of the chain link to be welded. The trough may, however, have, for example, rectangular cross-section.

The chain link moving and holding means of the present invention has two parallel substantially vertical and jointly upwardly and downwardly movable holding arms, the upper ends of which extend through and beyond recesses in the saddle and are capable of movement in opposite directions approximately at right angles to the central plane. The functions of moving and holding may be readily performed since the means are retractable and therefore insensitive to dirt resulting from scale and burrs which are splintered off and which might otherwise produce breakdowns in other forms of chain-welding machines. The holding arms, for example, may be leafsprings, on the confronting faces of which there is provided a small plate which engages the straight portions of the chain link which is to be erected and welded. If, instead of the small plate, there are secured to the upper end of the holding arms shaped bodies which are adapted to the space between the two chain links interengaged with chain link to be welded, a centering effect is achieved in that the chain link to be welded advantageously assumes, with respect to the welding electrodes of the apparatus, a symmetrical position. This equalizes the welding gaps which are determined by the distance between the ends of the chain link to be welded and the electrodes, and insures constant welding quality.

The moving and holding means of the present invention are provided with at least one, preferably double-acting, cylinder-piston unit, the piston rod of which is reciprocable at right angles to the guidance or central plane along a straight line so as to strike the upper end of one leaf-spring. The moving and holding means are further provided with at least one thrust rod adapted to reciprocate in a bore through the saddle at right angles to the guidance or central plane. The rod ends are rigidly connected to the cylinder and to an adjustable bolt, the axis of which coincides with the axis of the piston rod and which bears on the other leaf-spring. Since this construction implements the basis action/-reaction law of physics, a second cylinder-piston unit is therefore unnecessary so that the costs and complication of construction and control are diminished. To insure that the holding arms are disposed symmetrically with respect to the central plane as they grip the chain link to be welded, the arm cooperating with the piston rod is expediently provided with an adjusting screw which abuts the saddle when the holding arms are urged against a chain link to be welded.

BRIEF DESCRIPTION OF THE DRAWINGS

FIGS. 3 to 5 are variously broken away side views of the essential parts of the embodiment in various states;

FIGS. 6 and 7 are broken away sections on the lines VI—VI and VII—VII, respectively, in FIG. 1, through the embodiment;

FIGS. 8 and 9 are, respectively, a front view and a side view of a detail of the embodiment; and FIG. 10 is a plan view of a detail of an alternative form of the embodiment.

DETAILED DESCRIPTION OF THE DRAWINGS

Figure 1:
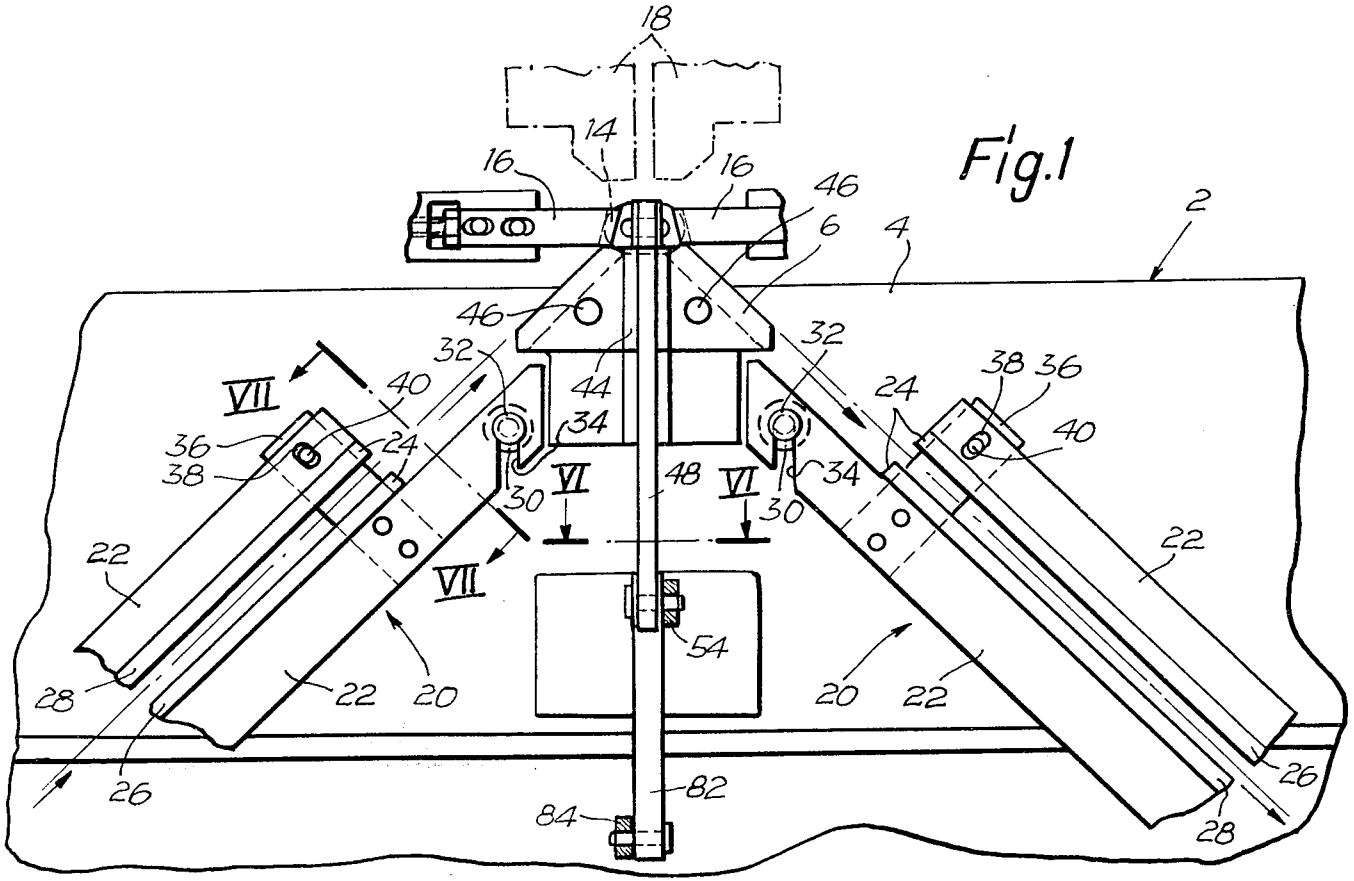
FIG. 1 is a partly broken away and diagrammatic front view of the embodiment.
Figure 2:
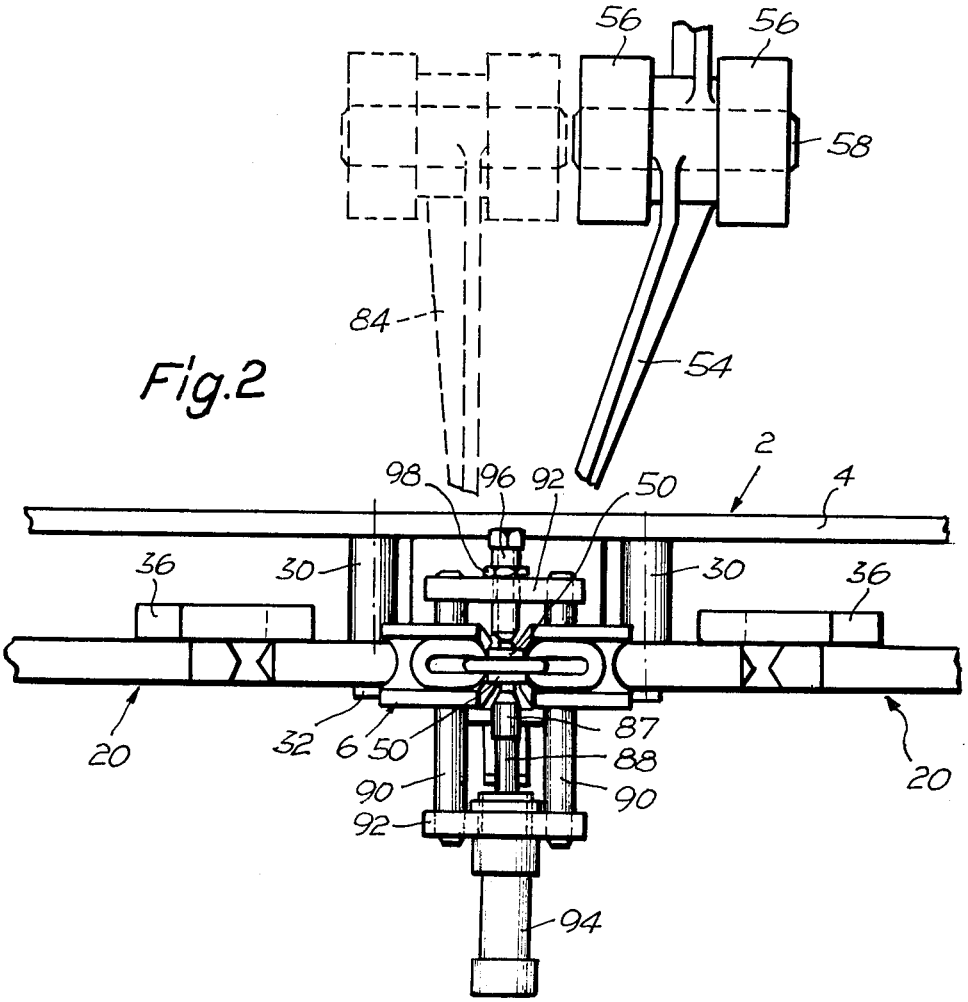
FIG. 2 is a plan view of a part of the embodiment.
Figure 8:
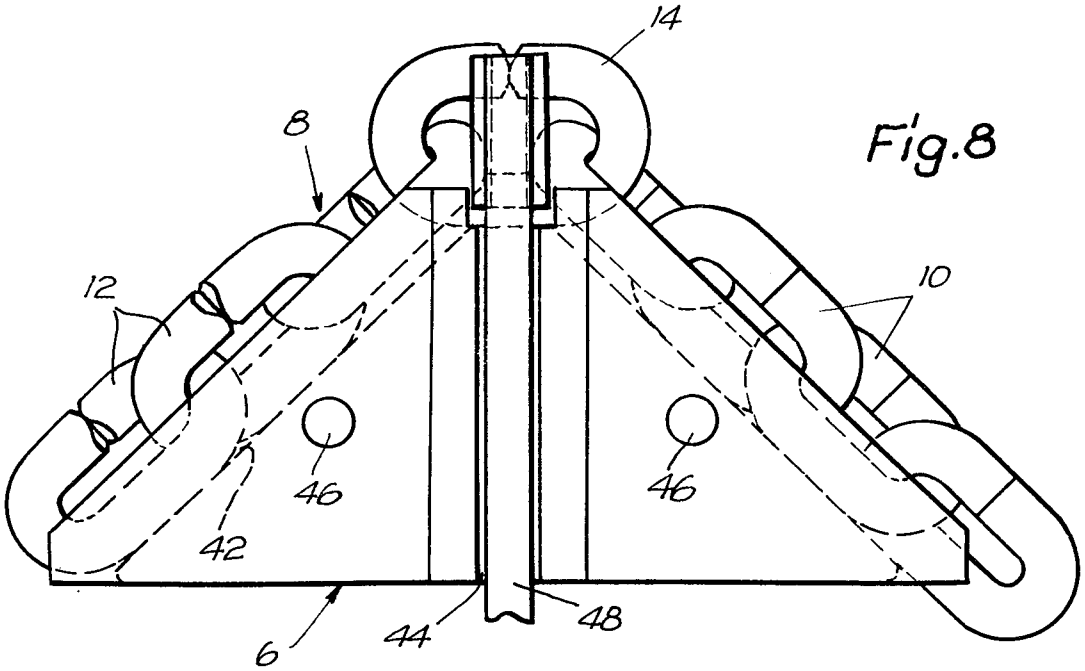

Referring to FIG. 1, an embodiment of the apparatus according to the invention has a frame 2 on which is mounted a vertically rising front plate 4. Attached forwardly of the front plate 4 and projecting above its upper edge is the saddle 6 over which is drawn, as illustrated in FIGS. 8 and 9, a chain strand 8 which consists of welded chain links 10 and unwelded chain links 12. At the apex of the saddle 6 is disposed a chain link 14 in position to be welded, the rounded ends of which are engaged by two compressing tools 16. The tools 16 are adapted for horizontal movement in opposite directions so as to exert the necessary bearing and upsetting pressure on the ends of the chain link 14 which is being welded. The portion of the chain strand 8 comprising both the welded chain links 10 and the unwelded chain links 12 is guided beneath the saddle 6 by guides 20 on the discharge side and approach side. Insofar as has been described, the embodiment is derived from apparatus known in the art.

Each of the guides 20 has two parallel upright strips 22 inclined at 45° with respect to the vertical and at 45° below the horizontal. The mutually confronting faces of the strips 22 of each guide 20 form a key 24 having two pair of inclined flanks 26 and 28, each pair of which encloses a right angle, as best seen in FIG. 7. The flanks 26 and 28 of both strips 22 of each guide 20 constitute first and second guide faces respectively for a first and second row of chain links. Each row comprises alternate chain links offset from each other by one chain link and, as viewed lengthwise of the chain strand, is oriented 90° with respect to the other row. Each row of chain links is oriented at an angle of 45° with respect to the vertical measured above and below the axis of the chain strand. The flanks 26 and 28 lie on oppositely disposed sides of the two straight portions (as viewed in FIG. 7) of the broad sides of all chain links in the first and second rows respectively. The parallel flanks 26 and the parallel flanks 28 of the key 24 determine a central plane for each of the first and second rows respectively, each central plane passing through the chain strand axis.

Each pair of associated strips 22 is rigidly but adjustably connected to the front plate 4 through a spacer 30 via the lower strip 22 which extends generally upwardly toward the saddle 6. For this purpose, head screws 32 are screwed into a tapped hole in each of the end faces of the round spacers 30, the shank of the said head screws engaging vertically disposed slots 34 extending obliquely to the longitudinal direction of the lower strips 22. Each upper strip 22 is connected to the associated lower strip through a connecting piece 36 and may be positioned in close proximity to or more remotely from the lower strip by means of an elongated slot 38 and a screw 40. Thus, the parts 32, 34, 38 and 40 make it possible to alter the position and angle of inclination of the guides 20 with respect to the vertical to suit requirements or to adjust the gap between associated strips 22.

The saddle 6 has, viewed from front and rear, a substantially triangular shape and is provided with an upwardly open trough 42 having a cross-section resembling a segment of a circle. On its approach and discharge sides, the trough 42 has a portion inclined at 45° to the vertical and at the apex of the saddle 6 there is a short horizontal portion which merges smoothly into the portions on either side, its length approximately corresponding to the length of the straight portion of the chain link 14. Along the plane of symmetry of the saddle 6 which is at right angles to the front plate 4 there is on the front and rear sides a vertical recess 44 which is widened in the region of the apex. Parallel to the plane of symmetry and below each oblique portion of the trough 42 extends a symmetrical bore 46. The functions of the recesses 44 and bores 46 will be explained hereinafter.

Figure 3:
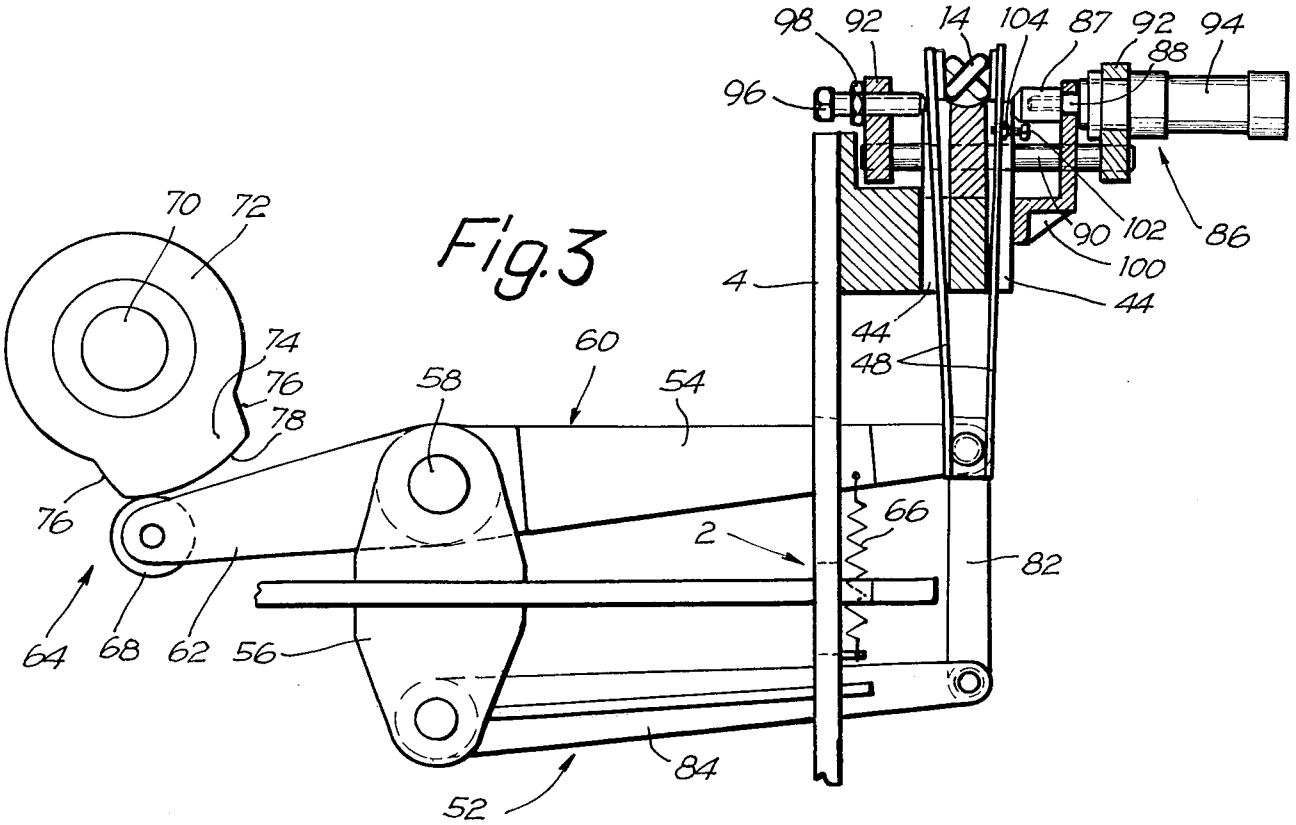

As shown in FIGS. 3 to 6, the embodiment includes moving and holding means for the chain link 14 disposed at the apex, the said means having two substantially vertical and parallel jointly upwardly and downwardly movable holding arms in the form of leaf-springs 48. On their facing inner surfaces, the upper ends of the leaf springs 48 are each provided with a small rectangular plate 50. While in their operative position, as best seen in FIG. 3, the plates 50 project through the recesses 44 of saddle 6 and above this latter, being substantially horizontally movable in opposite directions and approximately at right angles to the front plate 4. The upward and downward movement of the leaf-springs 48 is achieved by means of a parallelogram linkage 52. The upper arm of the parallelogram linkage 52 is one arm 54 of a lever 60 which is mounted by means of two bearing blocks 56 and a stub axle 58 so as to pivot about an axis parallel with the longitudinal axis of a chain link 14, the other arm 62 of the lever 60 being movable by means of a cam transmission 64. Between the arm 54 and the frame 2 is connected a traction-stressed coil spring 66. The cam transmission 64 has, mounted on the arm 62 of lever 60, a roller 68 and cooperating therewith and mounted on a control shaft 70, a camplate 72. The cam 74 of camplate 72 is provided with two steep flanks 76 and a control surface 78 which coincides with a circle concentric to the control shaft 70. The flanks 76 actuate the upward and downward movement of the leaf-springs 48 and the control surface 78 maintains the leaf-springs 48 in their operative position, as shown in FIGS. 3 and 4, so long as the roller 68 is rolling thereon. The lower arm 84 is mounted on the frame 2 in a manner similar to the arm 54. The two arms 54 and 84 are articulatingly connected by a flat bar 82, the bottom ends of the leaf-springs 48 being attached to the narrow sides of the upper end of the flat bar 82.

The moving and gripping means of the embodiment comprises a double-acting cylinder-piston unit 86, the piston rod 88 of which has at its free end a head 87. The piston rod 88 is arranged for reciprocating movement at right angles to the front plate 4 so as to strike the upper end of the front leaf-spring 48. The moving and gripping means furthermore has slidingly mounted in the bores 46 of the saddle 6 two round thrust rods 90, the mutually corresponding ends of which are connected to approximately triangular plates 92. The forwardly plate 92 is rigidly connected to the front cylinder 94 of the unit 86, the rearwardly plate 92 to an adjustable bolt 96, the axis of which coincides with the axis of the piston rod 88. The rods 90 are thus capable of reciprocating movement in the bores 46. The bolt 96 is screwed from the back into the rear plate 92 and secured thereto by a nut 98. The piston rod 88 is guided by an angled connecting part 100 mounted on the front of the saddle 6. The part 100 forms a stroke limiting abutment for the cylinder 94. The front leaf-spring 48 is provided with an adjusting screw 102 having a locking nut 104, the purpose of which will be subsequently described herein.

In the case of an alternative embodiment shown in FIG. 10, the leaf-springs 148 have at their upper ends, instead of plate 50, shaped bodies 150 for gripping the chain link 114 to be welded and which are disposed at the apex of the saddle 106 engaged between the facing rounded edges of the adjacent chain links 110 and 112 so as to urge them apart. Thus, the chain link 114 lies exactly in the plane of symmetry of the saddle 106.

The mode of operation of the above-described embodiment is, according to the method of the invention, as follows:

Assume the starting point to be a condition as indicated in FIG. 8, on the discharge side there is a portion of the chain strand 8 with already-welded chain links 10 and on the approach side a portion of the chain strand 8 with chain links 12 which are still to be welded. The lower straight portion of the broad side of the next chain link 14 which is to be welded is resting at the apex of the saddle 6, in the horizontal portion of the trough 42. The chain link 14 is so gripped by the plates 50 on the two leaf-springs 48 which are in their operative position and which rest at front and rear on the straight portions of the chain link 14, that the plane of the chain link coincides with a central plane equispaced from the planes defined by the plates 50. As shown in FIG. 4, in this condition the cylinder 94 and the bolt 96 are in their farthest forward position while the piston rod 88 is actuated rearwardly as far as possible. On a basis of this condition, the two compressing tools 16 are applied against the rounded portions of the chain link 14 with a predetermined pressure so that they secure it in position, Thereupon, the cylinder-piston unit 86 is preferably pneumatically operated so that the internal piston (not shown) thereof is subjected to a force on its rearwardly face. In consequence, the piston rod 88 is moved forwardly and the cylinder 94 and the bolt 96 are moved jointly rearwardly as far as the positions shown in FIG. 3. In this position the head 87 of the piston rod 88 abuts the rear face of the part 100 while the rearwardly face of cylinder 94 abuts the front face thereof.

Figure 5:
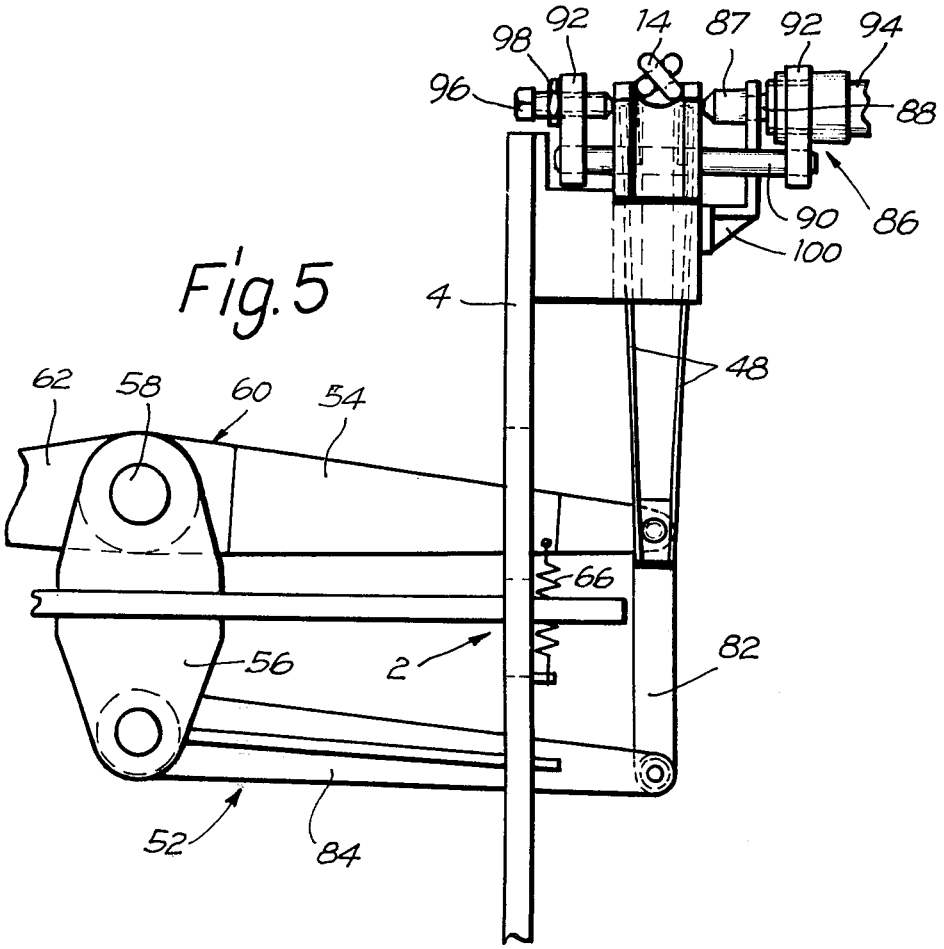
Figure 6:
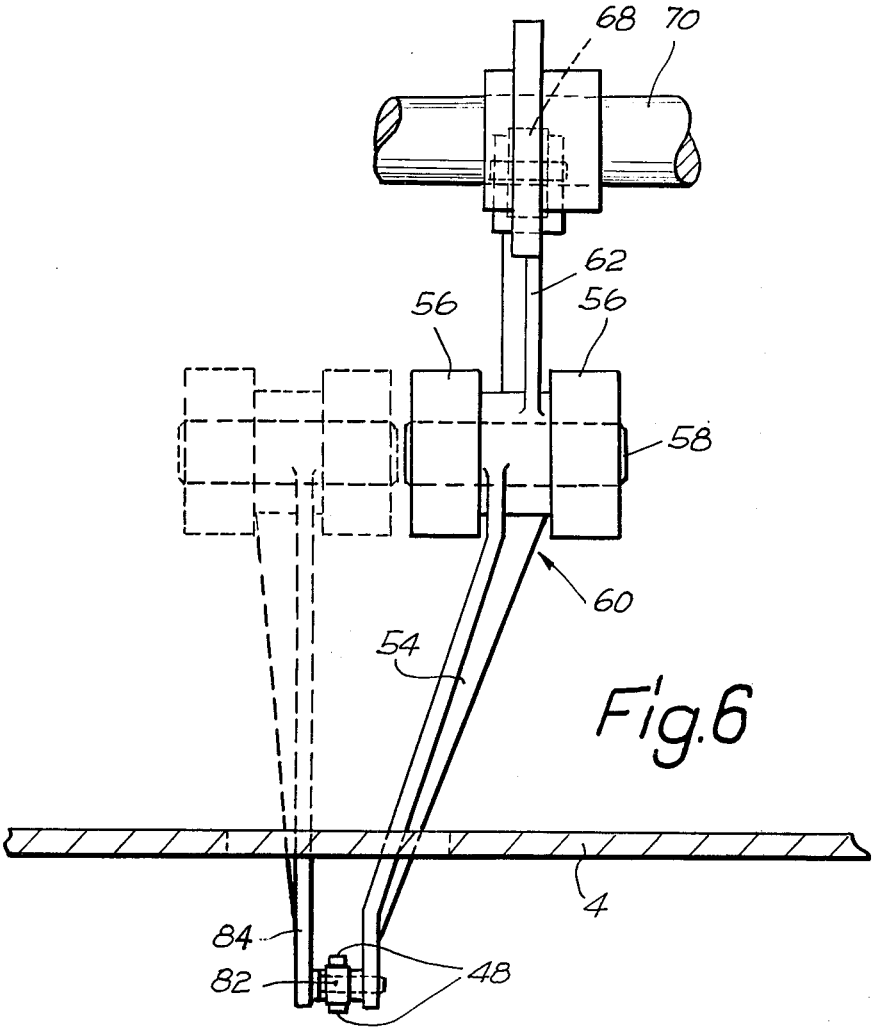

As the welding electrodes 18 are applied to the ends of the chain link 14, the leaf-springs 48 are actuated in opposite directions away from the link 14. Upon conclusion of the welding process, during which the pressure exerted by the compressing tools 16 has been increased to an upsetting pressure, the electrodes 18 are raised and the compressing tools 16 move apart. When this happens, the chain link 14 which has just been welded inclines naturally approximately 45° to one side. Now the transport tools (not shown) of the apparatus are actuated to transport the chain strand 8 by one division or step, i.e., the length of a chain link, to dispose another unwelded chain link 14 on the apex of the saddle 6. This natural inclination is, however, toward the other side, as FIG. 5 shows, i.e., oppositely of the chain position shown in FIG. 3. FIG. 5 shows the chain link 14 which has just been welded as well as the next chain link to be welded.

In order to erect the new unwelded chain link 14, the control shaft 70 is caused to rotate counterclockwise, as viewed in FIG. 3, until the leading flank 76 pivots the lever 60 about the stub axle 58 in counterclockwise direction, so that the leaf-springs 48, guided by the parallelogram linkage, are lifted substantially vertically upward into their operative position wherein plates 50 are adjacent the chain link 14. Erection is achieved by a simple rotation of the chain link 14 about its longitudinal axis. To accomplish this, the two plates 50 must be brought together as far as the thickness of the chain wire, as shown in FIG. 4. Applying a force to the front face of the internal piston (not shown) of the unit 86 moves the piston rod 88 against the front leaf-spring 48 and urges it rearwardly. If the force necessary to bend the front leaf-spring 48 tends to exceed the force of friction between the push rods 90 and the bores 46, a change in the movement will follow. While the piston rod 88 remains stationary, the cylinder 94 moves to the rear until it strikes the connecting part 100. During this time, simultaneously with the cylinder 94, the bolt 96 will have moved sufficiently far forwards as to bend the rear leaf-spring 48 into that position needed for the complete erection of the chain link 14. Now the piston 88 is constrained to move farther to the rear. The extreme position of the front leaf-spring 48 is reached when the adjusting screw 102 bears on the wall of the recess 44 provided in the saddle 6 for the front leaf-spring. Thus, the starting condition as shown in FIGS. 4 and 8 is restored, whereupon the cycle is repeated. The remarks made with respect to the movement of the leaf-spring 48 constitute a kind of slow-motion study. In reality, the leaf-springs move so quickly toward and away from each other that the human observer witnesses an apparent simultaneous movement of both leaf-springs. The guides 20 provide purely passive assistance in feeding and orienting the chain straid 8, while the coil spring 66 actively participates in the lowering of the leaf-springs 48 after application of the compressing tools 16 to the chain link 14 to be welded.

Many modifications and variations of the present invention are possible in light of the above teachings and within the purview of the appended claims without departing from the spirit and intended scope of the invention.

What I claim is:

1. Chain welding apparatus for welding successive interconnected links of a chain strand comprising:

a frame;

a saddle secured to said frame for supporting a chain link to be welded, said saddle having an approach side and a discharge side;

a guide means disposed on each of said approach and discharge sides of said saddle for supporting and guiding said chain strand, said guide means on at least said approach side having at least a first and a second guide face, each of said faces being adapted to guide alternate links respectively of said chain strand, the planes of said first and second guide faces enclosing an angle of at most approximately 45° on opposite sides respectively of a vertical plane through the longitudinal axis of the chain strand; and means attached to said frame and positioned adjacent said chain link to be welded for erecting and securely holding said link in an upright position for welding.

2. Chain welding apparatus according to claim 1 including a third and fourth guide face arranged in parallel relation with said first and second guide faces respectively, said first and third guide faces being adapted to bear against the oppositely disposed surface portions respectively of alternate links of said chain strand, said second and fourth guide faces being adapted to bear against the oppositely disposed broad surface portions respectively of the remaining links of said chain strand.

3. Chain welding apparatus according to claim 2, wherein said first and second guide faces are integrally connected to form a first key and said third and fourth guide faces are integrally connected to form a second key, said first and second keys being arranged in confronting relation and adapted to engage said chain strand from opposite sides thereof.

4. Chain welding apparatus according to claim 3, wherein said first and second guide faces intersect at a right angle and said third and fourth guide faces intersect at a right angle.

5. Chain welding apparatus according to claim 1, wherein said saddle includes an upwardly disposed trough for receiving said chain strand, said trough having a cross-section substantially in the form of a segment of a circle.

6. Chain welding apparatus according to claim 1, wherein each of the oppositely disposed sides of said saddle located at right angles to said approach and discharge sides thereof is provided with a vertical recess and wherein said means are erecting and holding said link to be welded comprises a pair of substantially vertical and parallel holding arms, each having upper and lower ends and adapted to move upwardly and downwardly jointly, each one of said arms being positioned in one of said recesses in said saddle, the upper ends of said arms being in confronting relation when in their upwardly position and being adapted to move in opposite directions approximately at right angles to a plane containing the longitudinal axis of said chain strand.

7. Chain welding apparatus according to claim 6, wherein said holding arms are leaf springs.

8. Chain welding apparatus according to claim 6, including a plate fixedly mounted on each confronting surface of the upper ends of said holding arms.

9. Chain welding apparatus according to claim 6 including shaped bodies fixedly mounted on each confronting surface of the upper ends of said holding arms, said bodies being so shaped as to conform to the surface of a chain strand adapted to be disposed in said saddle between said holding arms.

10. Chain welding apparatus according to claim 6, including a parallelogram linkage operatively connected to said holding arms for causing upward and downward movement of said arms.

11. Chain welding apparatus according to claim 10, wherein said parallelogram linkage comprises a lever pivotally mounted intermediately of its length to said frame and arranged to pivot about an axis parallel to the longitudinal axis of said chain link to be welded, one end of said lever being connectd to a flat bar, the lower ends of said holding arms being connected on the oppositely disposed narrow sides of said flat bar, the other end of said lever being operatively connected to a cam transmission.

12. Chain welding apparatus according to claim 11, including a spring connected between the said one end of said lever and said frame for providing a restoring force to said lever.

13. Chain welding apparatus according to claim 11 wherein said cam transmission comprises a roller rotatingly mounted on said other end of said lever, a camplate mounted on a rotatable control shaft and cooperating with said roller, the axis of said control shaft being arranged in a spaced and parallel relation with the pivotal axis of said lever.

14. Chain welding apparatus according to claim 6, wherein said means for erecting and holding said chain link to be welded includes at least one cylinder-piston unit operatively connected to said saddle and having a piston rod adapted to reciprocate along an axis at right angles to a vertical plane through the longitudinal axis of said link, the operative end of said piston rod being arranged to strike the outwardly facing surface of the upper end of one of said holding arms.

15. Chain welding apparatus according to claim 14, wherein said cylinder-piston unit is double-acting.

16. Chain welding apparatus according to claim 15, wherein said saddle is provided with a pair of spaced parallel bores disposed therethrough, said bores being positioned on opposite sides of the recesses in said saddle along axes parallel to the axis of said piston rod, and including a pair of thrust rods each one of which is slidingly disposed in one of said bores, one end of each of said rods being fixedly connected to said cylinder, an adjustable bolt disposed along an axis coincident with said piston rod axis and arranged to operatively bear against the outwardly facing surface of the upper end of the other of said holding arms, the other ends of each of said rods being operatively connected to said adjustable bolt.

17. Chain welding apparatus according to claim 16, including limiting guide means mounted on said saddle for guiding said piston rod and for limiting the stroke of said cylinder.

18. Chain welding apparatus according to claim 14, wherein said holding arm cooperating with said piston rod is provided with an adjusting screw disposed therethrough along an axis substantially parallel with the piston rod axis, one end of said screw being arranged to abut said saddle whereby axial adjustment of said screw varies the distance between the confronting surfaces of said holding arms.

19. A method of producing particularly high-strength chains by bending, interengaging and welding with at least a pair of movable welding electrodes successive lengths of chain wire to form a chain strand comprising the steps of:

arranging the broad side of alternate links of said chain strand at an angle of at most approximately 45° with respect to one side of a vertical plane through the longitudinal axis of the chain strand and parallel to the direction of motion of said electrodes:

arranging the broad side of the remaining links of said chain strand at an angle of at most approximately 45° with respect to the other side of said plane;

transporting said chain strand to a position adjacent said pair of movable electrodes whereby a chain link to be welded is longitudinally aligned with said electrodes;

rotating said chain link to be welded such that the broad sides of said chain link to be welded are upright and substantially parallel to the direction of motion of said welding electrodes, and welding said chain link with said electrodes; and transporting said chain strand to longitudinally align the next successive chain link to be welded with said welding electrodes.

20. The method according to claim 19, wherein said rotating step includes the step of substantially simultaneously applying forces to the parallel broad sides of said chain link to be welded to thereby rotate said chain link to be welded through said at most approximately 45° angle to an upright position for welding.

21. The method according to claim 19, wherein the bending of said length of chain wire is accomplished substantially simultaneously with said welding step.

* * * * *

UNITED STATES PATENT AND TRADEMARK OFFICE

CERTIFICATE OF CORRECTION

PATENT NO. : 3,934,407

DATED : January 27, 1976

INVENTOR(S) : GERHARD LANGE

It is certified that error appears in the above-identified patent and that said Letters Patent are hereby corrected as shown below:

Column 3, line 66, "positions" should be --portions--;

Column 8, line 51, "straid" should be --strand--;

Claim 6, line 5, change "are" to --for--.

Signed and Sealed this

*fifteenth* Day of *June 1976*

[SEAL]

*Attest:*

RUTH C. MASON
*Attesting Officer*

C. MARSHALL DANN
*Commissioner of Patents and Trademarks*